United States Patent [19]

Foley

[11] 3,933,287

[45] Jan. 20, 1976

[54] BOOK STRAP

[76] Inventor: Gerard Foley, P.O. Box 1191, New Rochelle, N.Y. 10802

[22] Filed: Oct. 31, 1974

[21] Appl. No.: 519,596

Related U.S. Application Data

[63] Continuation-in-part of Ser. No. 439,240, Feb. 4, 1974, Pat. No. 3,865,292.

[52] U.S. Cl. ..... 224/55; 224/58

[51] Int. Cl.[2] ..... B65D 71/00

[58] Field of Search ..... 224/55, 58, 49, 45 S, 46 R, 224/11, 12, 7 A, 7 B, 5 Z, 28 A, 28 B, 1 A, 5 Q, 5 MA

[56] References Cited

UNITED STATES PATENTS

| | | | |
|---|---|---|---|
| 734,934 | 7/1903 | Palmer | 224/53 |
| 1,082,017 | 12/1913 | Feiner | 224/55 |
| 2,169,080 | 8/1939 | Clark | 224/5 MA |
| 3,023,941 | 3/1962 | Foley | 224/58 |
| 3,495,770 | 2/1970 | Seltmann, Jr. et al. | 224/1 A |

FOREIGN PATENTS OR APPLICATIONS

| | | | |
|---|---|---|---|
| 536,664 | 6/1921 | France | 224/28 A |

*Primary Examiner*—Robert J. Spar
*Assistant Examiner*—Kenneth Noland
*Attorney, Agent, or Firm*—Wolf, Greenfield & Sacks

[57] ABSTRACT

A book strap is formed from three elastic elongate strips or straps, secured to each other in a cross-like configuration and having fasteners at the ends of the strips to enable the strips to be wrapped about a package such as one or more books or the like and secured at their ends. Two of the three straps are arranged so that when fastened to the package, an end portion of each defines a loop which serves as a handle to carry the package.

4 Claims, 2 Drawing Figures

BOOK STRAP

RELATED APPLICATIONS

This is a continuation-in-part of application Ser. No. 439,240 filed Feb. 4, 1974. now U.S. Pat. No. 3,865,292.

BACKGROUND AND SUMMARY OF THE INVENTION

The present invention relates, in general, to carrying devices and, more particularly, to an improved strap arrangement for carrying a package such as a number of books or the like.

My U.S. Pat. No. 3,023,941 shows one book strap arrangement. Although this was usable, it was found to be somewhat complicated in operation. In my application Ser. No. 439,240, there is disclosed another book strap arrangement which is primarily adapted to the carrying of books in a generally flat position, as shown therein. However, it has been found that it would be advantageous to provide a carrying arrangement wherein the books are supported in an upright position and in that way can be slung or carried at the side of the person more easily.

Accordingly, one object of the present invention is to provide an improved package or book carrying strap arrangement.

A further object of the present invention is to provide a carrying strap which can be easily attached and detached from the package or books.

Still a further object of the present invention is to provide a carrying strap which can be stretched to fit the package and which will retain a variety of packages of different sizes and shapes.

A further object of the present invention is to provide an improved book strap which can be folded to a compact size when not in use and which is particularly attractive to children of school age.

Still a further object of the present invention is to provide a book strap arrangement that is particularly adapted for carrying the books in an upright position wherein they may be swung by the person carrying the books.

To accomplish the foregoing and other objects of this invention, the device generally comprises three elastic straps, two of which define a parallel pair in which an end portion of each overlaps an end portion of the other. The overlapping end of each of the straps is movably connected to the other strap in the pair. A third strap is disposed perpendicular to the pair of first two straps. The first two straps are secured at a first common point and the third strap is secured to one of the first two straps and at a second common point. The third strap, which is connected at this second common point, is disposed in a crosslike configuration relative to the first two straps. The outermost ends of the straps include fastening members which enable the strap arrangement to be wrapped about a package. The overlapping ends of the straps of the first two straps may be arranged in loops to form carrying handles. The third strap is interconnected at a preselected point along one of the straps so that the carrying handles are disposed at an end of the books. The straps are preferably fabricated from an elastic material which also has good surface frictional characteristics so that the package is securely held by the strap.

BRIEF DESCRIPTION OF THE DRAWINGS

The foregoing and other objects and advantages of the invention will be understood more fully from the following description thereof, with reference to the accompanying drawings wherein.

DETAILED DESCRIPTION

Figure 1:
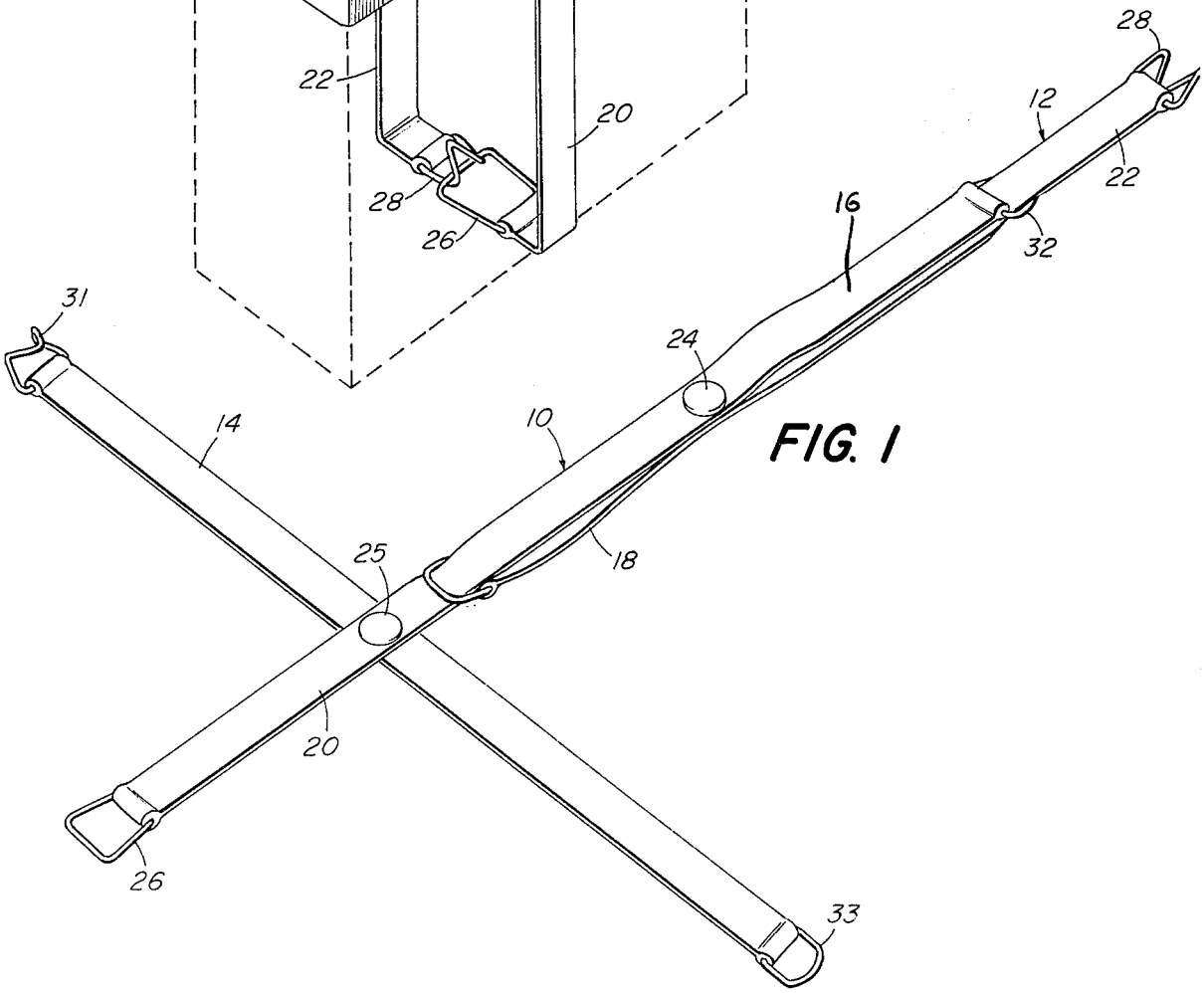
FIG. 1 is an illustration of the device spread out in a flat configuration.

FIG. 1 shows the device with its various straps laid out in a flat configuration. The device comprises three elongate, flat, elastic straps 10, 12 and 14. The straps 10 and 12 may be considered as defining a pair of straps. The pair of straps 10 and 12 are arranged so that when laid out flat as shown in FIG. 1, their inner ends 16 and 18, respectively, overlap each other. The outer ends 20 and 22 of the straps 10 and 12, respectively, extend outwardly beyond their associated inner ends 16 and 18. A suitable fastener 24 such as a riveted button or the like, secures the two straps 10 and 12 together at a first common point. In the embodiment shown, the short segment of the second strip underlies the long segment of the first strap and the short segment of the first strap overlies the long segment of the second strap. The first and second straps may be of the same length as may be the short segments of each of the straps.

The third strap 14 lies perpendicular to the pair of straps 10 and 12 and is secured by another suitable fastener 25 to the strap 10. Similarly, the third strap could also be fastened to the strap 12 of the pair of straps. The fastener 25 may be identical to the fastener 24.

Figure 2:
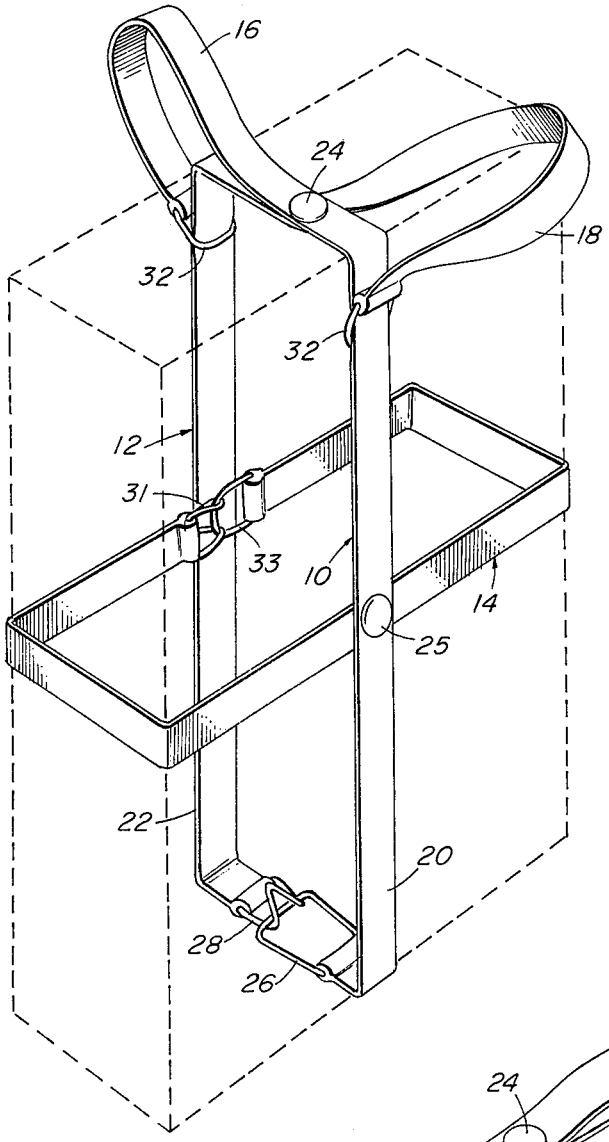
FIG. 2 is an illustration of the manner in which the device is employed to retain a package and provide a carrying handle therefor.

The outermost ends of the straps 10 and 12 include fasteners such as those shown, which may consist of a ring 26 secured at the outer end of the strap 10, and hook 28 secured to the opposite outer end of the strap 12. The strap 14 also includes a hook 31 and a ring 33 which are secured together as shown in FIG. 2.

The inner ends 16 and 18 of the straps 10 and 12, respectively, each include a slide ring 32 through which is passed the adjacent portion of the other strap in the pair. With this arrangement, as suggested in FIG. 2, when the strap arrangement has been secured to the package, the inner end segments 16 and 18 can be drawn upwardly to form carrying loops, as shown, which are disposed at the top end as shown in FIG. 2 for carrying the package or books in an upright manner.

The straps may be fastened to the package quite easily. For example, the pair of straps may first be fastened by passing the straps 10 and 12 about the package and engaging the hook 28 with the ring 26. Thereafter, the outer strap 14 is passed in the opposite direction and its ends are interconnected, as shown. It is noted, in particular, in FIG. 2, that the handles are at the top of the package and permit the package to be held in an upright position for easy carrying at the side of the person.

The straps 10, 12 and 14 may be made from any appropriate elastic material such as a synthetic rubber which preferably has relatively high frictional characteristics so that it may provide a still further grip on the articles being carried. Because of the elasticity and flexibility of the straps, they may be employed to retain a number of books or like articles which are of different sizes because the straps will conform to the general configuration of the articles which make up the package.

Each of the straps may be of different colors which may enhance their attractiveness to children of school age. The carrying loops formed by the segments 16 and 18 are easily and comfortably held.

It should be understood that the foregoing description of the invention is intended merely to be illustrative thereof and that other modifications and embodiments may be apparent to those skilled in the art without departing from the spirit and scope of this invenition.

What is claimed is:

1. A device for carrying a package comprising:

a first strap, a second strap and a third strap, each of said straps being formed from an elastic material;

means securing said first and second straps to each other at a common location between the ends of each of said straps to define a short segment and a long segment of each strap;

said first and second straps extending along substantially the same direction, said long segment of said first strap having an end which extends outwardly from said common location beyond the adjacent end of the short segment of said second strap, the opposite end of the long segment of said second strap extending beyond the corresponding opposite end of the short segment of said first strap;

a loop means secured to the shorter segment of said second strap and receiving the longer segment of said first strap therethrough;

the end of the shorter segment of said first strap having a loop means secured thereto and receiving the longer segment of said second strap therethrough;

means securing said third strap extending substantially transverse to said first and second straps to said first strap at a point intermediate said first common location and the end of the longer segment of the first strap; and fastener means secured to the outermost end of each of the longer segments of said first and second straps and to each of the ends of the third strap to enable said straps to be wrapped about said package with the outermost end of each of the longer segments of said first and second straps interconnected and the ends of the third strap separately interconnected.

2. A device as defined in claim 1 wherein said fastener means comprises:

a ring secured to the outermost end of said first strap; and a hook secured to the outermost end of said second strap, said ring and hook being constructed and arranged to enable the hook to be detachably connected to the ring.

3. A device as defined in claim 1 further comprising:

the short segment of said first strap overlying the long segment of said second strap and the short segment of said second strap underlying the long segment of said first strap.

4. A device as defined in claim 1 wherein the long segment of said first strap is somewhat longer than the long segment of said second strap.

* * * * *